United States Patent [19]

Silvia

[11] Patent Number: 4,998,963

[45] Date of Patent: Mar. 12, 1991

[54] EXPLOSIVE LOGIC CLOCK

[75] Inventor: Denis A. Silvia, Aberdeen, Md.

[73] Assignee: The United States of America as represented by the Secretary of the Navy, Washington, D.C.

[21] Appl. No.: 333,608

[22] Filed: Dec. 23, 1981

[51] Int. Cl.[5] ..... F42B 3/10; F42B 15/00; F42C 19/08

[52] U.S. Cl. ..... 102/275.9; 102/305; 102/701

[58] Field of Search ..... 102/275.1, 275.2, 275.3, 102/275.4, 275.5, 275.6, 275.7, 275.8, 275.9, 701, 305, 202, 202.1, 221, 222, 276

[56] References Cited

U.S. PATENT DOCUMENTS

| | | | |
|---|---|---|---|
| 3,035,518 | 5/1962 | Coursen | 102/305 |
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 102/701 X |
| 3,753,402 | 8/1973 | Menz et al. | 102/701 X |
| 3,768,409 | 10/1973 | Menz et al. | 102/275.9 |
| 3,973,499 | 8/1976 | Anderson et al. | 102/701 X |

*Primary Examiner*—David H. Brown

*Attorney, Agent, or Firm*—John D. Lewis; Kenneth E. Walden

[57] ABSTRACT

An explosive network forming an explosive logic clock for opening a time window during which a set of theoretically identical detonators must fire. The explosive logic clock also examines the first detonation to determine whether or not it is premature before propagating the detonations on to the explosive safing and arming network. The clock is constructed with a plurality of detonators, each detonator having a first branch of a branched outlet trail leading to a detonator time delay trail leading further to a logic switch. The logic switches are interconnected such that the detonation signal from the first detonator to detonate is extinguished in that detonator's logic switch while the remaining logic switches are set by the first detonation signal to allow propagation of their own detonation signals on to the safing/arming network. A second branch of the branched outlet trail simultaneously propagates the detonation signal from the first detonator to a clock time delay which delays the first detonation signal and opens the time window. When the delay imposed by the clock time delay expires, the first detonation signal propagates to a clock logic switch which is interconnected with and set by the detonator logic switches to allow propagation of the first detonation signal. When a second detonation signal is generated, it passes down the detonator time delay and through the detonator logic switch to the clock logic switch. When the second detonation occurs within the time window, the clock logic switch is set by the second detonation signal prior to the arrival of the first detonation signal, which is then allowed to propagate through the clock logic switch. However, when the second detonation occurs outside the time window, the first detonation signal arrives at the unset clock logic switch prior to the arrival of the second detonation signal and is extinguished.

14 Claims, 5 Drawing Sheets

EXPLOSIVE LOGIC CLOCK

BACKGROUND OF THE INVENTION

Many ordnance devices, such as projectiles, mines or bombs, require a fuze to detonate the device at the desired place and time. An important part of the fuze is the safety and arming device (S/A), which contains a group of explosive components called an explosive train. The explosive train may be in an out-of-line (safe) position or in an in-line (armed) position. When in the safe position, accidental initiation of any of the elements of the explosive train must not lead to detonation of the weapon. Conversely, when in the armed position, initiation of the explosive train must always lead to detonation of the weapon.

Prior art methods of safe/arming an explosive device consist of using mechanical devices or exploding bridgewire devices. The mechanical safe/arming devices physically interpose a barrier between the detonator explosive charge and the main charge of the weapon. Mechanical devices have several drawbacks in that environmental degradation over an extended storage period results in an increased failure rate. In addition, as weapon designs become more complex, the requirements placed on mechanical safe/arming devices have resulted in clockwork mechanisms which are large, expensive, complex, and thus more unreliable.

Exploding bridgewire devices have no primary explosive charge in the detonator. The bridgewire device initiates the main charge by providing a tremendous pulse of high voltage current to the bridgewire which causes the bridgewire to explode. This initiates a booster which in turn initiates the main explosive charge. Because the exploding bridgewire detonator does not contain any primary explosive, the detonator may be connected directly to a booster or the main charge without the necessity of a mechanical safing mechanism. The drawback of the exploding bridgewire detonator is that it requires an expensive high voltage power supply to provide the necessary current for exploding the bridgewire. This is not generally suitable for conventional ordnance.

A more suitable method of safe/arming modern weapons systems for high reliability and safety is the use of an explosive logic network interposed between the electronically actuated detonators and a booster charge which in turn detonates the warhead. The explosive logic network, such as that disclosed in copending Pat. application No. 317,961, filed on Nov. 4, 1981 receives an input from the detonators and performs syntactical or ordered operations to verify that a valid input combination has been received by the detonators.

The present invention of an explosive logic clock allows the explosive logic network to examine a set of detonators for simultaneous detonation in relation to the mean detonation time for the type of detonator. The explosive logic clock allows the network to consider the detonations as simultaneous if they fall within the mean time to detonate.

SUMMARY OF THE INVENTION

Accordingly, there is provided in the present invention an explosive logic clock for opening a time window during which a set of theoretical detonators must detonate and, more particularly, an explosive logic clock which examines the detonation signal from the first of a series of detonators to determine whether or not it is premature before propagating the detonations on to the explosive safing and arming network.

The explosive logic clock is constructed on upper and lower substrates with a set of theoretically identical detonators. Each detonator is provided with a branched or bifurcated explosive outlet trail having a first branch leading to an explosive detonator delay trail in series with an explosive logic switch.

The logic switches of each detonator are interconnected such that the detonation signal from the first detonator to detonate is extinguished in that detonator's logic switch while the other logic switches are set to allow propagation of their own detonation signals. The logic switches are set by the propagation of the first detonation signal down a second branch of the branched explosive outlet trail to the logic switches.

The setting of the detonator logic switches allows the respective detonator signals to propagate to the safe/arming network. The second branch of the explosive outlet trail also propagates the first detonation signal to an explosive clock time delay which delays the first detonation signal and opens a time window for a period equivalent to the mean time to detonate for that class or type of detonators. After the time delay expires, the first detonation signal propagates to an explosive clock logic switch which is interconnected with the detonator logic switches and can be set by a second detonation signal in the detonator logic switches so as to allow propagation of the first detonation signal.

When the second detonation signal is generated by one of the detonators, it propagates down the explosive detonator time delay and through the set detonator logic switch to the clock logic switch. If the second detonation occurs within the time window, the explosive clock logic switch is set by the second detonation signal, prior to the arrival of the first detonation signal at the clock logic switch, and thus allows propagation of the signal through the clock logic switch. However, when the second detonation occurs outside the time window, the first detonation signal arrives at the clock logic switch, prior to the setting of the clock logic switch by the second detonation signal, and the first detonation signal is extinguished in the clock logic switch.

A plurality of output logic switches in series are provided after the clock logic switch for directing the first detonation signal to the safing and arming network. Each output logic switch is interconnected with a detonator logic switch such that each detonator's signal will be furnished to the safing and arming network.

OBJECTS OF THE INVENTION

It is an object of the present invention to provide an explosive logic clock for a safe/arming network.

Another object of the present invention is to provide an explosive logic clock that opens a time window during which a set of theoretically identical detonators must detonate.

Another object of the present invention is to provide an explosive logic clock that examines a detonation to determine whether or not the detonation is premature.

A further object of the present invention is to provide an explosive logic clock which can be utilized with an explosive trail safe/arming network.

A further object of the invention is to provide an explosive logic clock that is mappable on a substrate.

A still further object of the present invention is to provide an explosive logic clock which is reliable, storable and less complex than mechanical devices.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages therein will be readily understood by reference to the following detailed description when considered with the accompanying drawings in which like reference numerals and letters designate like parts throughout the figures and wherein.

DESCRIPTION OF THE PREFERRED EMBODIMENT

Figure 1A:
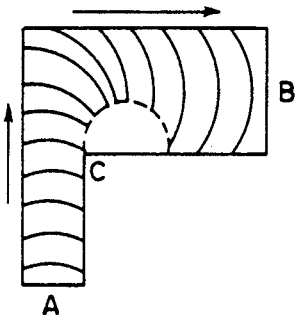
FIG. 1a PRIOR ART
FIGS. 1*a*, *b*, and *c* illustrate the corner effect in an explosive trail.
Figure 1B:
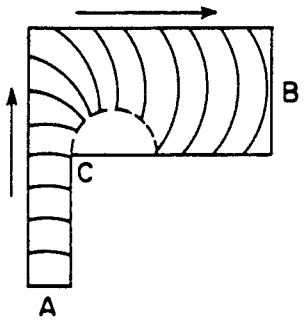
FIG. 1b PRIOR ART
Figure 1C:
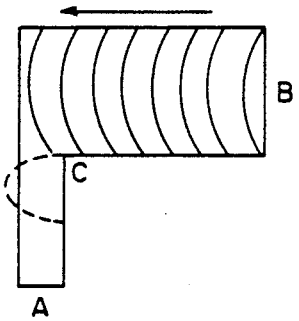
FIG. 1c PRIOR ART

Explosive logic networks for safe/arming devices of conventional and nuclear weapons are based on the "corner effect" principle discovered by Denis A. Silvia and Richard T. Ramsey of the Naval Surface Weapons Center, Dahlgren, Virginia. The corner effect occurs when a detonation wave propagating in an explosive sheet or trail tries to turn a sharp corner. As illustrated in FIGS. 1*a* and 1*b*, a detonation wave propagating from narrow trail A to wide trail B requires an increased width in trail B to negotiate corner C. As illustrated in FIG. 1*c*, a detonation wave propagating in an explosive trail from wide trail B to narrow trail A in negotiating corner C will turn wide around the corner and run out of room in the narrow explosive trail A and thus extinguish itself.

The principle of the corner effect can be used to establish an explosive diode or one way switch which, in effect, is the situation depicted in FIG. 1*c*. A detonation wave propagating from trail A will be able to turn the corner and proceed on to trail B but a detonation wave initiating in trail B will not be able to negotiate corner C, will extinguish itself, and will not propagate to trail A.

Figure 2A:
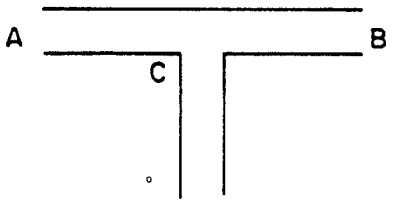
FIG. 2a PRIOR ART
FIGS. 2*a* and *b* illustrate the corner effect in a non-switched null gate.
Figure 2B:
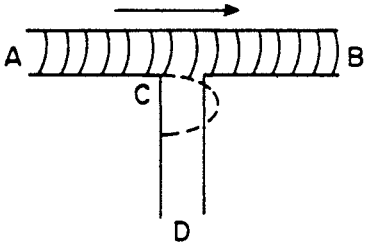
FIG. 2b PRIOR ART
Figure 3A:
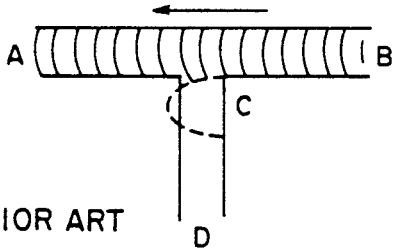
PRIOR ART FIG. 3a
FIGS. 3*a* and *b* illustrate the corner effect in a switching null gate.
Figure 3B:
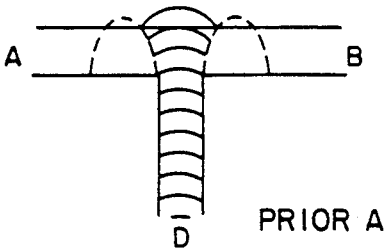
PRIOR ART FIG. 3b

As illustrated in FIGS. 2*a* and *b* and 3*a* and *b*, the corner effect can also be used to create a logic gate. FIGS. 2*a* and *b* illustrate a detonation wave propagating from trail A to trail B which, due to the corner effect, will not negotiate corner C and will not propagate down trail D. As illustrated in FIG. 3*a*, a detonation wave propagating from trail B to trail A will likewise not be able to negotiate corner C and thus will be prevented from propagating down leg or explosive trail D due to the corner effect. As shown in FIG. 3*b*, however, the detonation wave initiating in trail D will propagate to the intersection of trails A and B and will sever trails A and B and, again due to the corner effect, extinguish itself and not propagate down either trail A or trail B. The logic device described in FIG. 3*b* can be referred to as an explosive null gate. A detonation wave proceeding down trail D will disrupt trails A and B prior to a detonation wave passing along trails A and B and thus prevent passage of the detonation wave from trail A to trail B. In addition, the corner effect will prevent the detonation wave in trail D from turning into either trail A or trail B.

Figure 4:
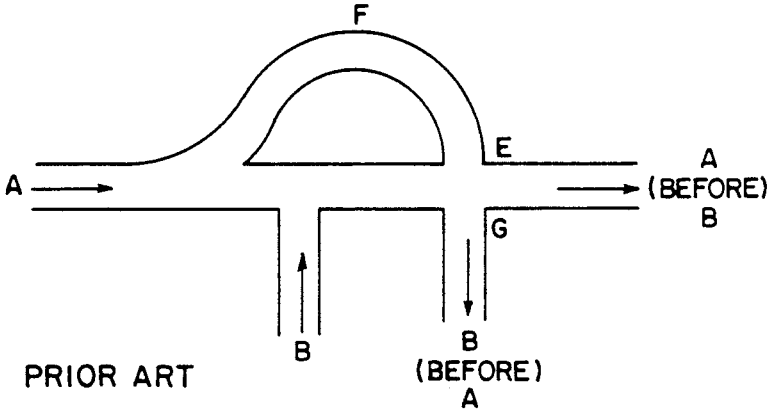
PRIOR ART FIG. 4
FIG. 4 illustrates an explosive logic switch.

The principle of the corner effect, as embodied in the explosive logic null gate, can be utilized in an explosive logic switch device illustrated in FIG. 4. A detonation wave initiated in trail A prior to the initiation of a detonation wave in trail B (A before B) will result in the wave proceeding down trail A and into outlet trail E. However, if a detonation wave is initiated in trail B of FIG. 4 prior to the initiation of a detonation wave in trail A (B before A), then the detonation wave in trail B will sever trail A at the null gate thus preventing passage of the detonation wave down A to E. Instead, the detonation wave will proceed on explosive loop F, thus bypassing the severed null gate, and proceed down outlet trail G. The detonation wave proceeding through loop F will proceed down trail G and not turn into trail E because of the corner effect. The incorporation of the corner effect, by means of the null gate in the explosive switch illustrated in FIG. 4, provides a logic switch for choosing between two possible sequences of events.

Typical safing systems used in conventional and nuclear warhead applications incorporate both electrical safing and mechanical safing or exploding bridge-wired detonator devices. The electrical safing device ensures that a false electrical pulse is not sent to the warhead detonator. The second safing device, such as an explosive logic network of secondary explosive imprinted on or grooved in an inert disc, protects the warhead from accidental functioning of the detonator, whether from electrical or other causes. The explosive logic network is a pattern of explosive trails which are formed on the disc with secondary explosive which due to its characteristics does not require safing. The detonation input to the explosive logic network is provided by a set of detonators. When the correct sequence of detonator function is input to the explosive logic network, a control detonation signal is allowed to propagate through the network and on to the main explosive or warhead. Any other combination of detonator functions is deemed to be an improper combination and extinguishes the control detonation signal in the explosive logic network before it can reach the warhead.

This "combination lock" approach to safing devices allows the selection of the number and combination of detonators which results in a malfunction rate of less than one in a billion. Proper choice of the detonators can also achieve a reliability of 0.999. The explosive logic network combines safety (no warhead function when none is required) and reliability (proper warhead function on command). In addition, the explosive logic network provides for flexibility and adaptability to complex detonation schemes with reduced cost, size, and power requirements.

Figure 5:
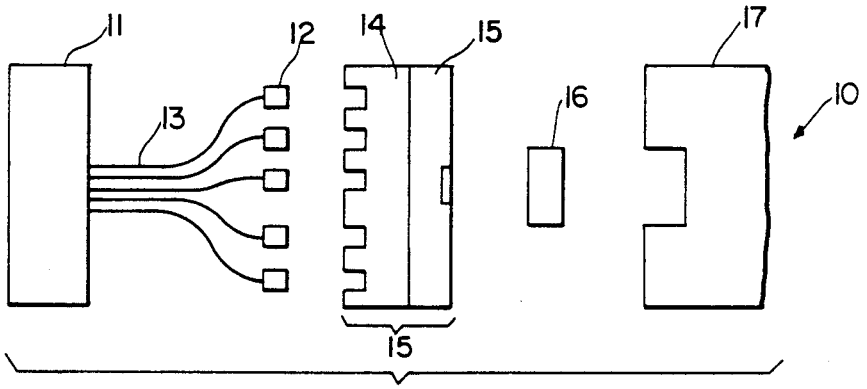
FIG. 5 PRIOR ART
FIG. 5 illustrates how a safe/arm device with the explosive logic clock of the subject invention can be incorporated into a missile or other system.

FIG. 5 illustrates the explosive logic network, incorporating the explosive logic clock of the subject invention, in a safe/arming device 10. The safe/arming device is provided with safe/arming electronics 11 which provide detonation signals by means of electrical conductors 13 to a set of detonators 12. The detonators are positioned in explosive logic clock 14 which is incorporated into explosive logic network 15 and constructed as one or more inert discs having explosive trails forming the explosive logic network. The output of the explosive logic network is used to initiate a booster charge 16 which in turn detonates the primary explosive charge or warhead 17.

The explosive logic network receives an input from the detonators in the form of an "object language" and performs syntactical or ordered operations to verify that a valid input combination has been received from the safe/arming electronics by means of the detonators. The safe/arming electronics receives input from the fuze and the explosive logic network validates the fuze's decision to determine whether input signals are from the fuze or from extraneous factors such as the environment. The explosive logic clock examines the first detonation to determine whether the detonation is premature and opens a time window during which a set of theoretically identical detonators must fire.

For an explosive logic safing device to operate as required, the detonator set provided must function within a specified time window. All the detonators will receive their input from the safe/arming electronics at the same time. However, due to the characteristics of individual detonators, there will be a time variation or "jitter" between the actual detonations of the detonators, even though they have received the same timed input.

Figure 8:
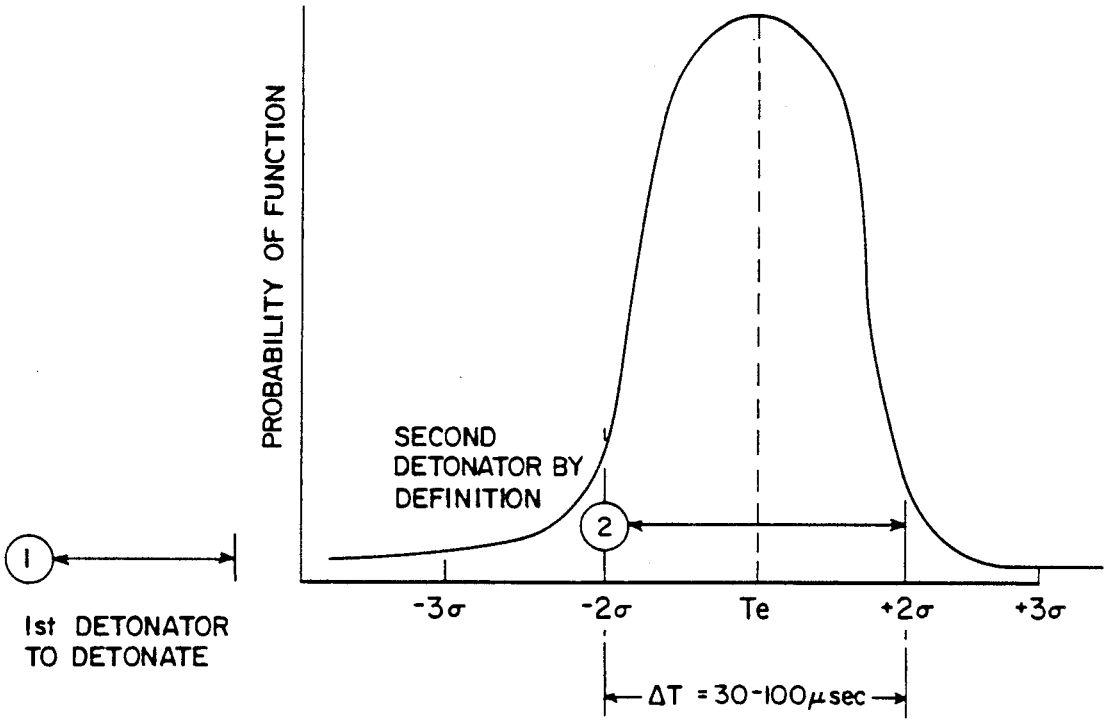
FIG. 8 illustrates a plot of a typical detonator's probability of functioning versus time.

The task of the explosive logic clock is to examine the detonations, and determine (a) which one should be chosen as a time standard (open the time window) and (b) if detonations earlier than the time standard are to be considered premature. $T_e$ is defined as the mean time to detonate for a given type of detonator and is determined by testing. As illustrated in FIG. 8, the probability of a given detonator functioning is at a maximum at $T_e$ and the statistical range of $6\sigma$ or $\pm 3\sigma$ encompasses approximately 99.9% of the detonators.

Because of the time variation inherent in the detonators, the time window must be opened by the detonators themselves. If the reliability standards require that four out of five detonators fire simultaneously for a proper output, for example, and the first detonation signal was used to control the time window, then a premature detonation would prematurely start the clock and lead to failure, because the clock would view the remaining detonators as late, even though the remaining four detonators fired simultaneously at the correct time. However, if the second detonator to detonate is selected to control the clock and the second detonator also detonates prematurely then the system fails, as it should, because only three out of five detonators can satisfy the requirement for simultaneity.

As illustrated in FIG. 8, the greatest probability of an individual detonator functioning is in the time span of 30–100 u sec which encompasses $T_e \pm 2\sigma$ for a range of $4\sigma$. If the first detonator to detonate functions within, for example, $-3\sigma$ of $T_e$ it will be seen by the explosive logic clock as not being premature. However, if the first detonator detonates prior to $-3\sigma$, as illustrated in FIG. 8, the explosive logic clock will detect the prematurity and not propagate the detonation on to the safe/arming network.

Figure 6:
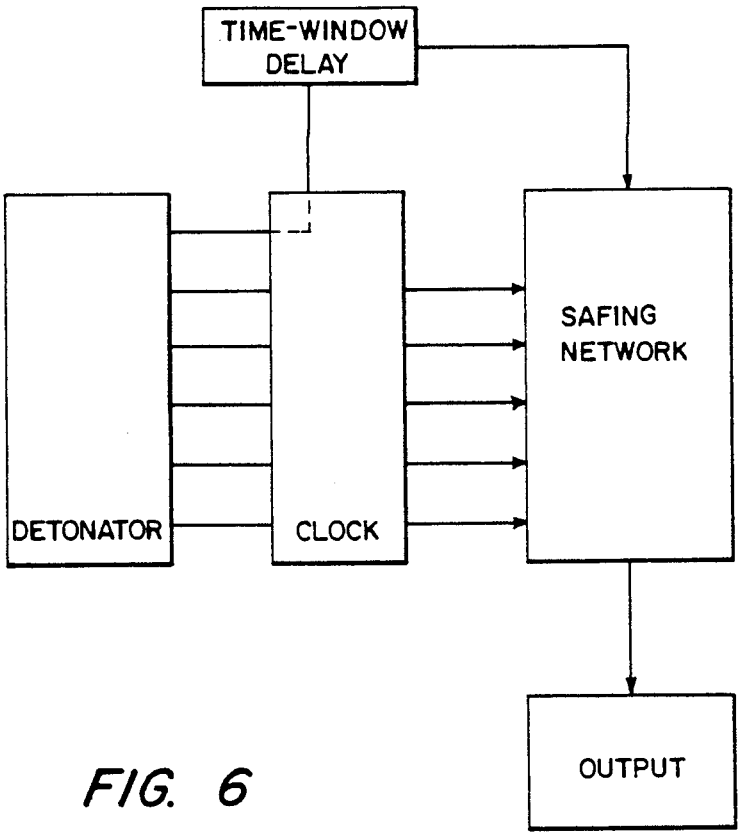
FIG. 6 illustrates a primitive clock.
Figure 7:
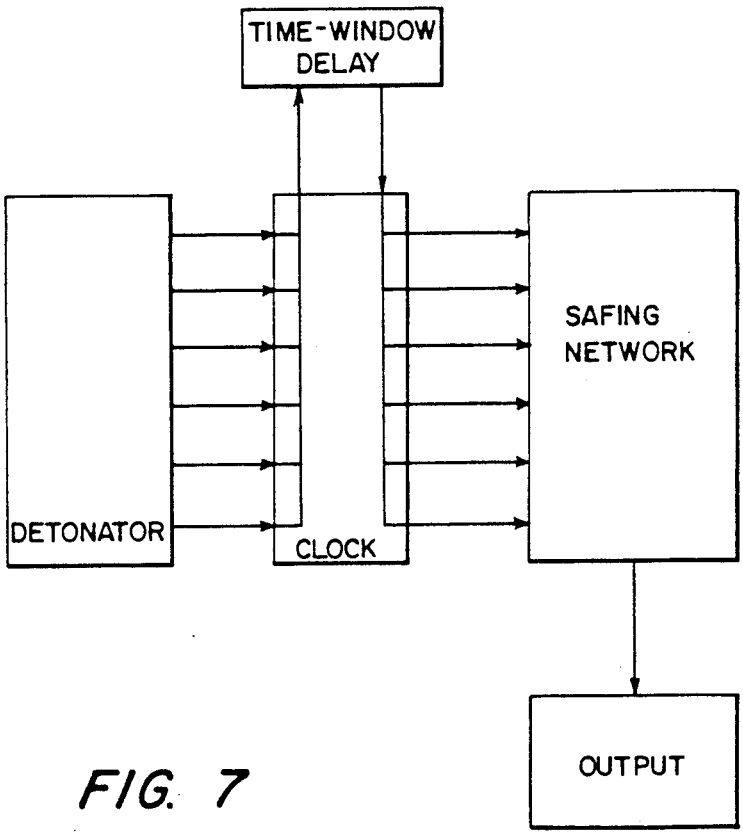
FIG. 7 illustrates a simple clock.

The evolution of the explosive logic clock can be best understood by referring to FIGS. 6 and 7. FIG. 6 illustrates in block diagram a primitive clock which takes the signal from a single detonator and runs the signal through a time window delay path. The delay path controls the closing of the time window while the single detonator controls the starting of the clock. The drawback of the primitive clock is that the functioning of the entire safe/arming network depends on one detonator. If the single detonator is too early or too late, then the entire network fails, even though the other detonators function properly.

FIG. 7 illustrates in block diagram a simple clock which overcomes the drawback of the primitive clock by tying all the detonators together so that the first one to detonate will start the clock. The functioning of one detonator is not critical to the operation of the clock. As with all of the explosive logic clocks, the time window delay path, in conjunction with the network path length, controls the closing of the time window. The drawback of the simple clock is that the clock starts with the first detonation. If any detonator should function too early, the clock will start too early and the time window will open and close before the other timely detonators have an opportunity to function.

FIG. 8 illustrates that the probability that a detonator will not be premature increases with the second, third, etc. detonator to function. This would indicate that a proper clock, by definition, should not be controlled by the first detonator to detonate, which may be premature. Instead, a proper clock should be controlled by the first detonator that must function in order for the network to function properly. In a network where four out of five detonators must function simultaneously for an output to the safe/arming network, the clock will be controlled by the second detonator, for example. In a network where six out of ten detonators must function, the clock would be controlled by the fifth detonator. Additionally, a proper clock, by definition must examine the prior detonations to determine if they are really premature or just slightly earlier than the controlling definition.

Figure 9A:
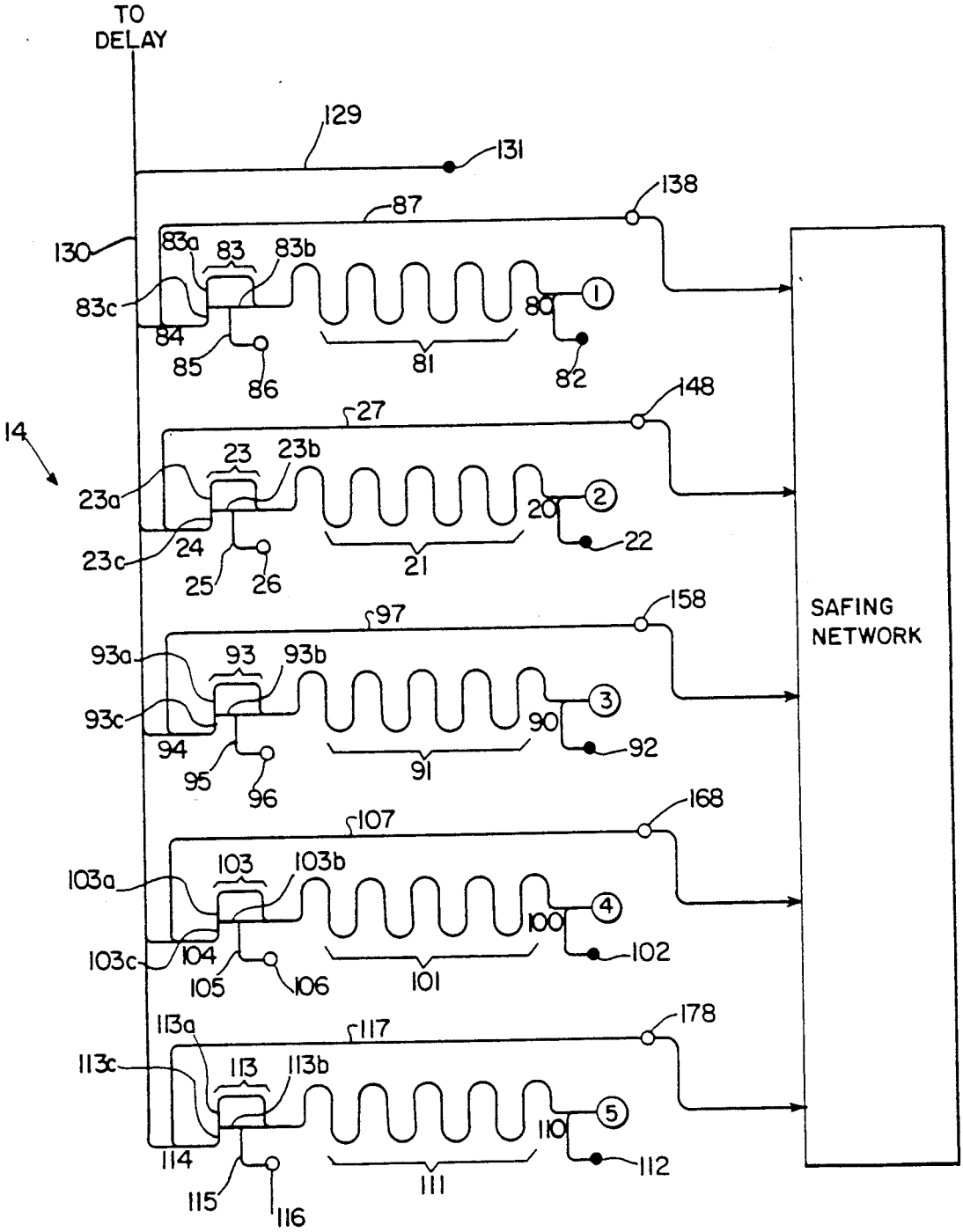
FIGS. 9*a* and 9*b* illustrate the explosive logic clock of the subject invention.
Figure 9B:
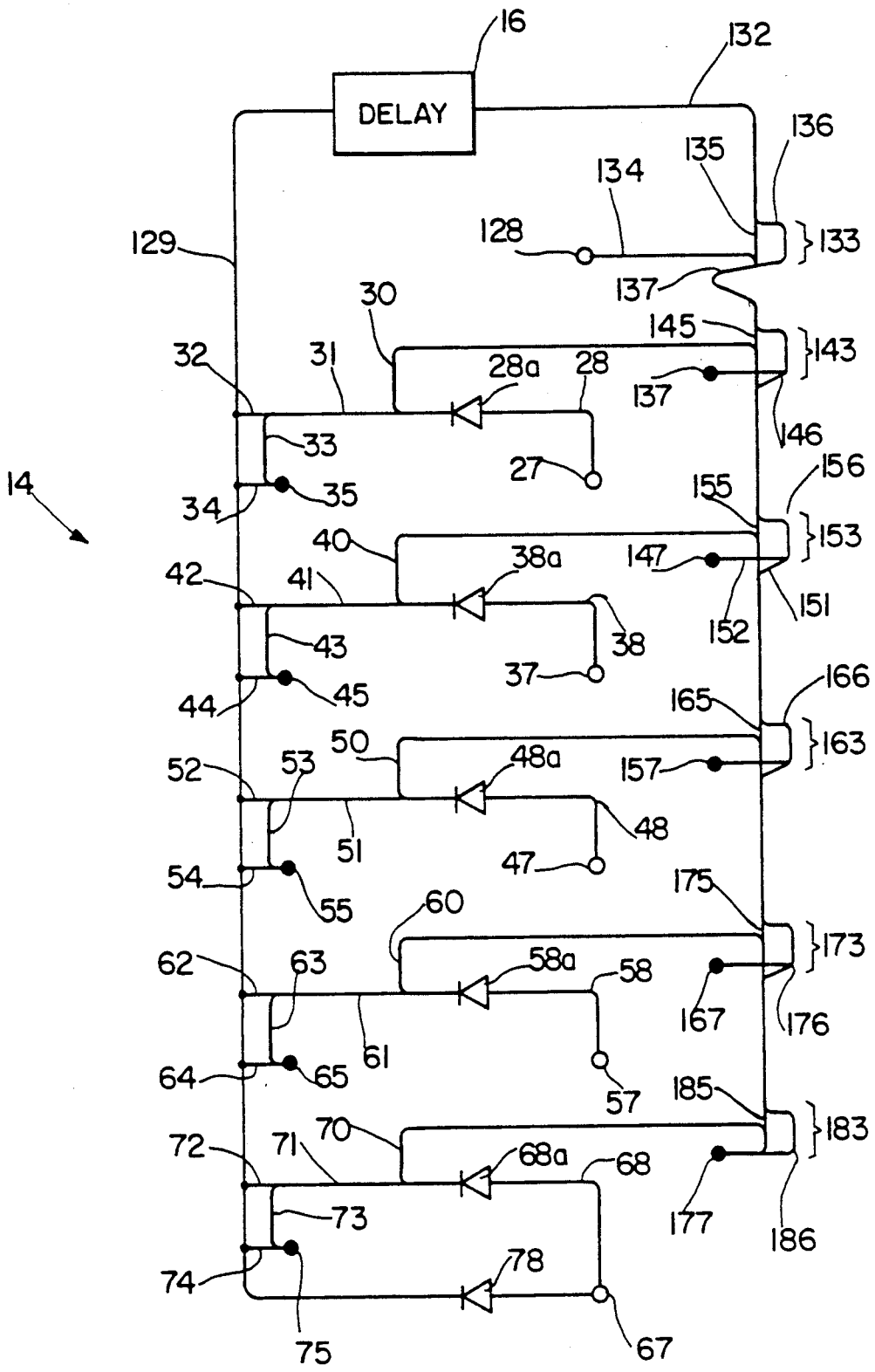

Referring to FIGS. 9*a* and 9*b* there is schematically illustrated explosive logic clock 14 of the subject invention.

FIG. 9*a* illustrates a first level of the explosive logic clock while FIG. b illustrates a second level of the clock. For purposes of explanation, FIG. 9*a* will be referred to as the lower level of the clock while FIG. 9*b* will be referred to as the upper level of the clock. It is to be on two or more tiers or could instead be constructed on the reverse faces of a single plate. The upper and lower levels of the clock are constructed by positioning trails of explosive material which does not require safing in an inert substrate. For notational purposes, in explaining the physical layout of the clock a closed circle such as that illustrated at 82, 22, 92, 102, and 112 of FIG. 9*a* illustrates that the explosive trail is leaving one level of the clock and transferring to the other level of the clock, such as passing from the lower level to the upper level. An open circle such as that illustrated at 138, 148, 158, 168 and 178 indicates that an explosive trail is arriving at one level from the other level. A dot at the intersection of explosive trails indicates that the corner effect is not operative and a detonation will be propagated along all exit trails.

Referring to FIG. 9*a* the lower level of the explosive clock is provided with a set of theoretically identical detonators, illustrated here as 1, 2, 3, 4, and 5. For purposes of explanation, the associated trails of detonator No. 2 will be explained in detail. It is to be understood that the remaining detonators are also provided with similar explosive trails.

Detonator 2 is provided with an outlet trail which branches at 20 with one branch proceeding to detonator time delay 21 while the second branch proceeds to closed circle terminus 22 and passes to the upper level of the explosive clock. Time delay 21 leads to an explosive logic switch 23 which is provided with explosive loop 23*a*, straight trail 23*b* and outlet trail 23*c*. Outlet trail 23*c* from explosive switch 23 branches at 24 into a first branch 27 which proceeds to a safing network. A second branch of outlet trail 23*c* merges into a first common explosive trail 130 which proceeds to an explosive time window delay 16.

Referring to FIG. 9*a* it can be seen that closed circle terminus 22 passes an explosive trail to open circle terminus 37, FIG. 9*b*, which is provided with an explosive trail 38 having an explosive diode 38*a* which prevents reverse detonation propagation in explosive trail 38. Explosive trail 38 branches at 39 to form trails 40 and 41. Trail 40 leads to an outlet explosive switch 153 which is one of a series of outlet explosive switches which will be discussed in detail later. Explosive trail 41 also branches to form explosive trails 42 and 43. Trail 42 ties in to a second common explosive trail 129 which leads to the time window delay 16. Explosive trail 43 dead ends at a further explosive trail 44 and functions as a null gate to sever explosive trail 44 which leads to a closed circle terminus 45 indicating that an explosive trail passes from the upper level to the lower level at open circle terminus 26 of FIG. 9*a*.

Second common explosive trail 129 serves as an inlet trail for time window delay 16. The time window delay is provided with an explosive outlet trail 132 which leads to a clock logic switch 133.

Clock logic switch 133 is provided with explosive loop 136 and straight trail 135. Logic switch 133 is also furnished with a setting explosive trail 134 having open circle terminus 128 which receives an explosive trail from closed terminus 131 of FIG. 9*a*. Closed circle terminus 131 is positioned in explosive trail 129 which branches from first common explosive trail 130.

To explain the operation of the explosive circuitry described thus far, we will assume that upon receipt of a simultaneous detonation command from the safe arming electronics, the first detonator to respond with a detonation will be detonator 2. It is to be understood that the following explanation will apply to any of the remaining detonators and their associated explosive logic circuitry.

Referring again to FIG. 9*a*, upon detonation of detonator 2, a detonation signal is propagated in the outlet trail of the detonator to bifurcation or branching 20. At branching 20 the detonation signal is split into two signals with a first detonation signal entering the detonator time delay 21 while a second signal proceeds to closed circle terminus 22 and propagates to the upper level, FIG. 9*b*, at open circle terminus 37.

The detonation signal propagating through detonator time delay 21 arrives at explosive logic switch 23. The detonation signal enters explosive loop 23*a* and also enters straight trail 23*b*. Because of the difference in distance that the detonation signal must travel through explosive loop 23*a*, which is longer than straight trail 23*b*, the detonation signal in straight trail 23*b* arrives at outlet trail 23*c* prior to the detonation signal in explosive loop 23*a*. Because straight trail 23*b* intersects outlet trail 23*c* as a null gate, the detonation signal in 23*b* severs the outlet trail 23*c* thus extinguishing the detonation signal. It can be seen by referring to FIG. 9*a* that explosive logic switch 23 is provided with setting explosive trail 25 which upon receipt of a prior detonation signal propagating through trail 25 could sever straight trail 23*b* thus setting explosive logic switch 23 and allowing a detonation signal to propagate down outlet trail 23*c*. However, when detonator 2 is the first to detonate, under our assumption here, there will be no detonation signal in explosive trail 25 to set logic switch 23 and prevent the detonation signal in logic switch 23 from being extinguished.

Returning to the detonation signal that has been propagated to closed circle terminus 22 from branch 20, this signal has been shifted to the upper level of the explosive clock at open circle terminus 37, FIG. 9*b*. The detonation signal from open circle terminus 37 is propagated down explosive trail 38 to branch 39. It should be noted that trail 38 is provided with an explosive diode 38*a* which prevents reverse propagation of detonation signals in trail 38 when detonator 2 is not the first to detonate. At branching 39 the detonation signal is again split into two components, one propagating in explosive trail 40 and a second propagating in explosive trail 41. The detonation signal propagated in explosive trail 40 is conveyed to an outlet explosive logic switch 153 which is one of a series of explosive switches which are connected in series with clock explosive switch 133.

The detonation signal propagated in explosive trail 41 is conveyed to explosive trails 42 and 43. As illustrated in FIG. 9*b*, explosive trail 43 intersects a further explosive trail 44 as a null gate and severs explosive trail 44 thus preventing propagation to closed circle terminus 45. If explosive trail 44 was not severed by the detonation signal in trail 43, it could be seen that a detonation signal traveling down explosive trail 44 to closed circle terminus 45 could be passed from the upper level to the lower level of the explosive logic clock at open circle terminus 26, FIG. 9*a*, which leads to explosive trail 25 acting as a null gate for explosive logic switch 23. The importance of this sequence of events is illustrated by the fact that the detonation signal propagated in explosive trail 42 is conveyed to the second common explosive trail 129 which leads to time window delay 16 and also leads to the remaining branches of the explosive circuitry on the upper level or tier. A detonation signal entering common explosive trail 129 will not only propagate in one direction to time delay 16 and explosive trails 32 and 34 but will also propagate in the reverse direction and branch into explosive trails 52, 54, 62, 64, 72 and 74.

The function of the detonation signal propagating in explosive trails 34, 54, 64 and 74, as shown in FIG. 9*b* and 9*a*, is to transfer a detonation signal by means of closed circle terminuses 35, 55, 65, and 75 to open circle terminuses 86, 96, 106, and 116. The detonation signal is thus transferred from the upper level of the clock to the lower level of the clock and enters explosive setting trails 85, 95, 105, and 115. It can thus be seen from FIG. 9*a* that a detonation signal propagating in explosive setting trails 85, 95, 105, and 115 will act as a null gate and sever straight explosive trails 83*b*, 93*b*, 103*b*, and 113*b*, respectively. This results in the setting of explosive logic switches 83, 93, 103, and 113 and will allow a detonation signal to propagate in outlet trails 83*c*, 93*c*, 103*c*, and 113*c*, respectively.

When the detonation signal propagating in second common explosive trail 129 enters explosive trails 32, 52, 62, and 72, it can be seen by referring to FIG. 9*b* that further detonation propagation will be prevented in explosive trails 28, 48, 58, and 68, respectively by the presence of explosive diodes 28*a*, 48*a*, 58*a*, and 68*a*, positioned in their respective explosive trails. Propagation in explosive trails 30, 50, 60, and 70 branching from bifurcations 29, 49, 59, and 69 will also be prevented by the angle of intersection of the trails and the corner effect.

To summarize the above explanation of the propagation of detonation signals in the explosive logic circuitry after a detonation signal is generated by detonator 2, the detonation signal has been extinguished in explosive logic switch 23, the explosive logic switches for the remaining detonators, 1, 3, 4 and 5 have been set to allow propagation of a detonation signal from the explosive switches, and a detonation signal has been propagated to time window delay 16 and is running the course of the time delay before propagation to time delay outlet trail 132.

When the detonation signal exits from time window delay 16 and into time delay outlet trail 132 it is propagated to clock logic switch 133. Clock logic switch 133 is provided with explosive loop 136 and straight explosive trail 135. As can be seen by FIG. 9*b* explosive trail 134 intersects straight explosive trail 135 to form a null gate. When the detonation signal from time delay 16 reaches explosive clock logic switch 133 the signal is propagated simultaneously to explosive loop 136 and straight explosive trail 135. If switch 133 has not been set by a detonation signal in explosive trail 134, then the signal in straight trail 135 will arrive at clock logic switch outlet trail 137 prior to the detonation from explosive loop 136 and sever the outlet trail 137 and extinguish the detonation signal. To prevent extinguishing of the detonation signal, a second detonator must fire within the time window thus generating a detonation signal in open circle terminus 128 and explosive setting trail 134, thus setting clock logic switch 133 prior to the arrival of the detonation signal from the first detonator to fire, detonator 2. This validates the first detonation as not being premature.

For purposes of explanation, it will be assumed that detonator 4, illustrated in FIG. 9*a*, will be the second detonator to fire. Detonator 4 propagates a detonation signal to branching 100, splitting the signal into two signals. A first signal is propagated through time delay 101 while a second signal is propagated to closed circle terminus 102 and transferred to the upper level at open circle terminus 57, FIG. 9*b*. It can be seen that the detonation signal transferred to the upper level at open circle terminus 57 will be extinguished at explosive diode 58*a* due to the prior consumption of the explosive trail past diode 58*a* by the first detonation signal.

The detonation signal propagated in detonator time delay 101, FIG. 9*a*, will progress to explosive logic switch 103 which has previously been set by the first detonation signal propagating through explosive trail 105. The set logic switch propagates the detonation signal into outlet trail 103*c* to branching 104. The detonation signal at 104 is again bifurcated into two detonation signals. A first signal enters trail 107 and progresses onward to the safing network. A second component enters the first common explosive trail 130. The detonation signal propagated in first common explosive trail 130 is propagated on to time delay 16 and also propagated into explosive trail 129 which leads to closed circle terminus 131 which transfers the detonation signal to the upper level, FIG. 9*b*, of the clock at open circle terminus 128. Open circle terminus 128 propagates the detonation signal to explosive trail 134 which severs straight trail 135 thus setting the clock logic switch 133 to allow propagation of the first detonation signal to outlet trail 137. Thus it can be seen that if the first detonation signal generated by detonator 2 is not premature in relation to the second detonation signal, in this case generated by detonator 4, the second detonation signal will set clock logic switch 133 and allow propagation of the first detonation signal through clock logic switch 133.

As illustrated in FIG. 9*b* outlet trail 137 of clock logic switch 133 can propagate the detonation signal on to a series of outlet explosive logic switches 143, 153, 163, 173, and 183, each of which is connected to a respective detonator circuitry by explosive setting trails 30, 40, 50, 60 and 70, respectively. When detonator 2 generated a detonation signal which propagated from closed circle terminus 22 to open circle terminus 37, explosive trail 38, and branching 39, the detonation signal was thus propagated in explosive trail 40 which intersected straight explosive trail 155 of outlet explosive logic switch 153. The intersection of explosive trail 40 and straight explosive trail 155 forms a null gate and upon receipt of the detonation signal in explosive trail 40 severs explosive trail 155 thus allowing propagation of the first detonation signal through explosive loop 156 from straight explosive trail 145 of outlet logic switch 143 which received the signal from clock logic outlet trail 137. Explosive loop 156 propagates the signal to trail 152 and closed circle terminus 147 which transfers the first detonation signal to open circle terminus 148 of explosive trail 27 on the lower level of the explosive clock, illustrated in FIG. 9*a*. Thus the first detonation signal is shifted back to the lower level of the clock and can progress onward to the safing network because it has been validated as being not premature in relation to the second detonation generated by detonator 4.

As illustrated in FIG. 9*b* the detonation signal from outlet explosive switch 153 is also propagated in explosive trail 151 which leads to the remaining outlet explosive trails.

As the remaining detonators generate their detonation signals, detonators 1, 3, and 5, respectively, the detonation signals propagate down detonator time delays 81, 91, and 111 to explosive logic switches 83, 93, and 113, respectively. The explosive logic switches propagate the signals from detonators 1, 3, and 5 to explosive trails 87, 97, and 117, respectively, and thus on to the safing network.

Although the subject explosive logic clock circuitry has been described in the preceding with the assumption that detonator 2 generates a first detonation signal while detonator 4 generates a second detonation signal, it is to be understood that any of the illustrated detonators could generate the first or second detonation signals and the described circuitry would function as illustrated It is also to be understood that although the explosive logic clock of the subject invention was described for purposes of illustration as having a set of 5 detonators, any number of detonators could be provided, as required, with the prematurity of the prior detonations being validated by any selected detonator, as required, It is thus apparent that the disclosed explosive logic clock provides a means for opening a time window through which a set of theoretically identical detonators must detonate. The clock of the subject invention also examines a detonation or series of detonations to determine whether or not the prior detonations are premature. The explosive logic clock of the subject invention can be readily utilized with an explosive trail safe/arming network and is reliable, storable, and less complex than mechanical safing devices.

Many obvious modifications and embodiments of the specific invention other than those set forth above will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the U.S. is:

1. An explosive logic clock for opening a time window in which a plurality of detonators must function to output to a safing network and for validating that the first detonator to function is not premature, comprising:

first detonation means creating a first detonation means signal;

second detonation means creating a second detonation means signal;

means opening a time window, said time window means connected to the detonation means such that the time window is opened by a first detonation signal; and means validating that the first detonation signal is not premature in relation to the second detonation signal, said validation means connected to the time window means and the second detonation means such that when the first detonation signal is premature the first detonation signal is extinguished.

2. The explosive logic clock of claim 1 further comprising additional detonation means.

3. The explosive logic clock of claim 2 wherein the first detonation means comprises:

a first detonator;

a first bifurcated outlet trail connected to the first detonator;

a first time delay connected to the first detonator by the outlet trail; and a first logic switch connected to the first time delay, said first switch extinguishing a detonation signal exiting the first time delay when the first detonator is the first to detonate and propagating the detonation signal when the first detonator is not the first to detonate.

4. The explosive logic clock of claim 3 wherein the second detonation means comprises:

a second detonator;

a second bifurcated outlet trail connected to the second detonator;

a second time delay connected to the second detonator by the second outlet trail, and a second logic switch connected to the second time delay, said second switch extinguishing a detonation signal exiting the second time delay when the second detonator is the first to detonate and propagating the detonation signal when the second detonator is not the first to detonate.

5. The explosive logic clock of claim 4 wherein a first branch of the first bifurcated outlet trail is connected to the first time delay and a second branch of the first bifurcated outlet trail sets the second logic switch of the second detonator to propagate a detonation signal exiting the second delay trail when the first detonator is the first to detonate and a first branch of the second bifurcated outlet trail is connected to the second time delay and a second branch of the second bifurcated outlet trail sets the first logic switch of the first detonator to propagate a detonation signal exiting the first delay trail when the second detonator is the first to detonate.

6. The explosive logic clock of claim 5 wherein each additional detonation means comprises:

a detonator;

a bifurcated outlet trail connected to the detonator;

a time delay;

a first branch of the bifurcated outlet trail connected to the time delay;

a logic switch connected to the time delay, said logic switch extinguishing a detonation signal exiting the time delay when a particular detonator is the first to detonate and propagating the detonation signal when the detonator is not the first to detonate;

a second branch of the bifurcated outlet trail setting the logic switches of the other additional detonators except for the particular detonator to propagate a detonation signal exiting the additional detonator time delays when the particular detonator is the first to detonate.

7. The explosive logic clock of claim 6 wherein the time window comprises a clock time delay connected to the second branch of the bifurcated outlet trails of the first, second and additional detonation means, said clock time delay opening the time window during which a second detonation signal must occur.

8. The explosive logic clock of claim 7 wherein the validation means comprise a clock logic switch connected to both the clock time delay and the logic switches of the detonation means such that the clock logic switch is set by a detonation signal exiting the logic switch of the second detonator to detonate, said clock logic switch extinguishing a detonation signal exiting the clock time delay when the second detonation does not occur within the time window and propagating the detonation signal from the clock time delay when a second detonation does occur within the time window.

9. The explosive logic clock of claim 8 further comprising a plurality of logic switch means connected in series with the clock logic switch, each of said plurality of logic switches corresponding to a detonation means such that the logic switch means directs the first detonation signal of the detonation means to the safing network when the first detonation is not premature.

10. An explosive logic clock for propagating a plurality of detonation signals to a safing network, comprising:

a plurality of detonation means creating a plurality of detonation signals;

means opening a time window during which the plurality of detonation signals must occur; and means validating the detonation signals.

11. The explosive logic clock of claim 10 wherein each detonation means comprises:

a detonator;

a bifurcated outlet trail connected to the detonator, said bifurcated outlet trail having first and second branches;

a time delay connected to the first branch;

a logic switch connected to the time delay, said logic switch extinguishing a first detonation signal exiting the time delay when the detonator is the first to detonate and propagating the detonation signal when the detonator is not the first to detonate.

said second branch of the bifurcated outlet trail being connected to the logic switches of the other detonators so as to set the logic switches of the other detonators and propagate the detonation signal from the other detonators when they are not the first to detonate.

12. The explosive logic clock of claim 11 wherein the means opening a time window comprises a clock time delay connected to the second branch of the bifurcated outlet trails of the detonation means, said clock time delay opening the time window during which a second detonation signal must occur.

13. The explosive logic clock of claim 12 wherein the means validating the detonation signal comprises a clock logic switch connected to both the clock time delay and the logic switches of the detonation means such that the clock logic switch is set by a detonation signal exiting the logic switch of the second detonator to detonate, said clock logic switch extinguishing a detonation signal exiting the clock time delay when the second detonation does not occur within the time window and propagating the detonation signal from the clock time delay when a second detonation does occur within the time window.

14. The explosive logic clock of claim 13 further comprising a plurality of logic switch means connected in series with the clock logic switch, each of said plurality of logic switches corresponding to a detonation means such that the logic switch means directs the first detonation signal of the detonation means to the safing network when the first detonation is not premature.

* * * * *